US006976908B2

(12) United States Patent
Masunaga et al.

(10) Patent No.: US 6,976,908 B2
(45) Date of Patent: Dec. 20, 2005

(54) POLISHING HEAD AND POLISHING APPARATUS

(75) Inventors: Takayuki Masunaga, Yokohama (JP); Shinobu Oofuchi, Kawasaki (JP); Hiromichi Isogai, Shibata (JP); Katsuyoshi Kojima, Shibata (JP)

(73) Assignees: Kabushiki Kaisha Toshiba, Tokyo (JP); Toshiba Ceramics Co., LTD, Tokyo (JP)

( * ) Notice: Subject to any disclaimer, the term of this patent is extended or adjusted under 35 U.S.C. 154(b) by 0 days.

(21) Appl. No.: 11/001,047

(22) Filed: Dec. 2, 2004

(65) Prior Publication Data

US 2005/0124269 A1 Jun. 9, 2005

(30) Foreign Application Priority Data

Dec. 5, 2003 (JP) ..... 2003-407755

(51) Int. Cl.[7] ..... B24B 5/00

(52) U.S. Cl. ..... 451/288; 451/398

(58) Field of Search ..... 451/285, 286, 451/287, 288, 289, 291, 397, 398

(56) References Cited

U.S. PATENT DOCUMENTS

2001/0041522 A1 * 11/2001 Shendon et al. ..... 451/288
2002/0039879 A1 * 4/2002 Zuniga et al. ..... 451/288

FOREIGN PATENT DOCUMENTS

JP 2000-202762 7/2000
JP 2002-527893 8/2002

* cited by examiner

*Primary Examiner*—Jacob K. Ackun, Jr.
(74) *Attorney, Agent, or Firm*—Oblon, Spivak, McClelland, Maier & Neustadt, P.C.

(57) ABSTRACT

A polishing head includes a head body, a first recessed portion formed in the lower surface of the head body, a support plate which can be moved up and down in the first recessed portion, a first film-like member in which a first space is formed between the upper surface of the support plate and the head body, a second recessed portion formed in a lower surface of the support plate, a second film-like member, in which a second space is formed between the second film-like member and the support plate, and which holds a wafer on the lower, a communicating hole which is formed in the support plate to communicate the first space with the second space, and a gas supply device which increases pressures in the first and second spaces with a fluid to equal pressures to bring the object into press contact with the polishing pad.

11 Claims, 7 Drawing Sheets

POLISHING HEAD AND POLISHING APPARATUS

CROSS-REFERENCE TO RELATED APPLICATIONS

This application is based upon and claims the benefit of priority from prior Japanese Patent Application No. 2003-407755, filed Dec. 5, 2003, the entire contents of which are incorporated herein by reference.

BACKGROUND OF THE INVENTION

1. Field of the Invention

The present invention relates to a polishing head and a polishing apparatus to polish the surface of an object to be processed such as a wafer.

2. Description of the Related Art

For example, wafer manufacturing steps include a polishing step of mirror-finishing the surface of a wafer. In this step, a wafer polishing apparatus brings a wafer into press contact with the surface of a rotating polishing pad to polish the surface of the wafer.

This wafer polishing apparatus has a polishing table rotated by a drive shaft. A polishing pad is arranged on the upper surface of the polishing table, and a polishing head which rotates while holding a wafer is arranged at a position opposing the polishing surface of the polishing pad.

FIG. 10 is a sectional view of a conventional polishing head. Reference numeral 105 in FIG. 10 denotes the polishing pad.

As shown in FIG. 10, the polishing head has a head body 100. A compression chamber 101 is formed in the head body 100, and a lower-surface opening 102 of the compression chamber 101 is sealed with a rubber film 103. A wafer U is held on the lower surface of the rubber film 103. The wafer U is surrounded by a ring-like retainer 104 fixed on the lower end face of the head body 100. The retainer 104 extends to the inside of the head body 100 in the radial direction. The outer peripheral portion of the rubber film 103 is supported on the upper surface of the retainer 104.

When the wafer polishing apparatus having the above configuration is to be used, the rotating polishing head is moved downward to bring the retainer 104 held on the lower end face of the head body 100 into press contact with the surface of the polishing pad 105. At this time, when a gas is supplied into the compression chamber 101 to expand the rubber film 103, the wafer U adhesively fixed to the lower surface of the rubber film 103 is brought into press contact with the rotating polishing pad 105, so that the surface of the wafer U is polished.

In the wafer polishing apparatus having the configuration, the outer peripheral portion of the rubber film 103 is held on the upper surface of the retainer 104. For this reason, depending on the vertical thickness of the retainer 104, the entire surface of the wafer U cannot be polished at a uniform polishing rate.

More specifically, as shown in FIG. 11A, when the thickness of the retainer 104 is large, the level at which the rubber film 103 is supported is higher than the upper surface of the wafer U, and a desired force cannot be loaded on the edge portion of the wafer U. For this reason, a necessary contact pressure cannot be given between the edge portion of the wafer U and the polishing pad 105, so that the edge portion of the wafer U is less polished than the central portion of the wafer U.

As shown in FIG. 11C, when the vertical thickness of the retainer 104, a level at which the rubber film 103 is supported is lower than the upper surface of the wafer U, and the edge portion of the wafer U is overloaded. For this reason, a contact pressure between the edge portion of the wafer U and the polishing pad 105 excessively increases to polish the edge portion of the wafer U more than the central portion. That is, circumferential droop disadvantageously occurs.

Therefore, in order to polish the entire surface of the wafer U at a uniform polishing rate, as shown in FIG. 11B, the vertical thickness of the retainer 104 must be appropriately set.

However, since the retainer 104 is always in slidable contact with the polishing pad 105 when the wafer U is polished, the vertical thickness of the retainer 104 gradually decreases by abrasion. For this reason, even though the vertical thickness of the retainer 104 is appropriately set depending on the thickness of the wafer U in an initial state, the position at which the rubber film 103 is supported comes down to cause circumferential droop.

In this manner, in order to polish the entire surface of the wafer U at a uniform polishing rate, the retainer 104 must be selected depending on the thickness of the wafer U. Furthermore, an amount of abrasion of the retainer 104 must be always monitored. For this reason, the wafer polishing apparatus having the configuration disadvantageously increases the load on an operator.

In recent years, as an apparatus which can polish the entire surface of the wafer U at a uniform polishing rate even though the retainer is worn, a separation type polishing head which holds the wafer U to make it possible to move the wafer U up and down based on the retainer is disclosed (for example, see Patent Application National Publication (Laid-Open) No. 2002-527893).

FIG. 12 is a sectional view of a conventional separation type polishing head.

As shown in FIG. 12, the polishing head has a head body 201 which is rotatably driven. The head body 201 has a recessed portion 201*a* formed in the lower surface of the head body 201. A ring-like retainer 202 is fixed to the outer peripheral portion of a portion of the head body 201 which is in contact with the polishing pad.

A plate-like support plate 203 is almost horizontally arranged inside the recessed portion of the head body 201. The plate-like support plate 203 is supported such that the plate-like support plate 203 can move up and down inside the head body 201. On the outer peripheral portion of the upper surface of the plate-like support plate 203, an isolation film 204 is arranged such that the isolation film 204 overlaps the outside of the outer peripheral portion in the radial direction. The isolation film 204 has flexibility. The edge portion of the isolation film 204 is supported by the head body 201.

In this manner, a first space 205 surrounded by the head body 201, the plate-like support plate 203, and the isolation film 204 is formed in the plate-like support plate 203 on the upper surface side. A first gas supply pipe 206 is connected to the first space 205. A gas is supplied from the first gas supply pipe 206 to the first space 205 to make it possible to pressure the upper surface of the plate-like support plate 203.

In addition, a recessed portion 207 is formed on the lower surface of the plate-like support plate 203. The recessed portion 207 is sealed with a rubber film 208. A second space 209 is formed between the plate-like support plate 203 and the rubber film 208. The wafer U is held on the lower surface of the rubber film 208. A second gas supply pipe 210 is connected to the second space 209. A gas is supplied from the second gas supply pipe 210 into the second space 209 to make it possible to pressure the lower surface of the plate-like support plate 203.

When the wafer U is polished by using the polishing head having the above configuration, the rotating head body 201 is moved down to bring the retainer 202 fixed on the lower end face of the head body 201 into press contact with the surface of a polishing head 211. A gas is supplied into the first space 205 and the second space 209 to adjust the pressures in the first and second spaces 205 and 209, so that the wafer U adhesively fixed on the lower surface of the rubber film 208 is brought into press contact with the polishing head 211.

In this manner, in the separation type polishing head, the head body 201 and the plate-like support plate 203 are independently driven. For this reason, even though the retainer 202 is worn to decrease the vertical thickness of the retainer 202, the level at which the rubber film 208 is supported is not adversely affected. As a result, the edge portion of the wafer U is not excessively polished, or, contrarily, the edge portion is not slightly polished. [Patent Application National Publication No. 2002-527893].

However, in polishing of the wafer U by using the polishing head, when the first space 205 or the second space 209 changes in pressure, the level of the plate-like support plate 203 changes, and the wafer U may not be preferably polished.

For example, when the pressure in the first space 205 is lower than that in the second space 209, the plate-like support plate 203 moves upward by a balance between pressures acting on the upper and lower surfaces of the plate-like support plate 203. At this time, since the rubber film 208 which holds the wafer U expands upward by the pressure in the second space 209 to trace an arc, a contact pressure acting between the edge portion of the wafer U and the polishing pad is lower than that of the central portion of the wafer U. As a result, the edge portion of the wafer U is not easily polished.

When the pressure in the first space 205 is higher than that in the second space 209, the plate-like support plate 203 moves downward due to the balance between pressures acting on the upper and lower surfaces of the plate-like support plate 203. At this time, the rubber film 208 which holds the wafer U shrinks upward to some extent by the pressure in the second space 209 to trace an arc. For this reason, a contact pressure acting between the central portion of the wafer U and the polishing pad is lower than that of the edge portion of the wafer U. As a result, the central portion of the wafer U is not easily polished.

FIG. 13 is a simulation graph showing a change in contact pressure in the radial direction of the wafer U when the pressure in the first space is changed. In this graph, a pressure given to the second space is fixed to 200 [hPa], and a pressure given to the first space is changed into [1] 205 [hPa], [2] 200 [hPa], and [3] 195 [hPa].

As shown in FIG. 13, when the pressure in the first space is [1] 205 [hPa], a contact pressure between the wafer U and the polishing pad at the central portion of the wafer U is about 200 [hPa]. In contrast to this the contact pressure sharply increases at the edge portion of the wafer U.

As also shown in FIG. 13, when the pressure in the first space is [3] 195 [hPa], a contact pressure between the wafer U and the polishing pad at the central portion of the wafer U is about 200 [hPa]. In contrast to this, the contact pressure sharply decreases at the edge portion of the wafer U.

In this manner, when the wafer U is polished by using a conventional polishing head, changes in pressure in first and second spaces cause a large difference between polishing rates of the central and edge portions of the wafer U.

BRIEF SUMMARY OF THE INVENTION

The present invention has been made in consideration of the above circumstances, and has as its object to provide a polishing apparatus which can accurately polish the surface of an object to be processed without being influenced by the thickness of the object or a retainer and which can reduce an influence of a change in pressure in a first or second space on a polishing rate.

In order to solve the problem and to achieve the object, a polishing head and a polishing apparatus according to the present invention have the following configurations.

According to a first aspect of the present invention, there is provided a polishing head comprising: a head body which is arranged to oppose a polishing surface of a polishing pad; a first recessed portion which is formed in a surface of the head body, the surface opposing the polishing pad; a support plate which is arranged in the first recessed portion, substantially in parallel with the polishing surface and which can be moved in directions in which the support plate is brought into contact with the head body or separated from the head body; a first film-like member which is arranged to extend from a surface of the support plate, the surface opposing the head body, to an inner surface of the first recessed portion and in which a first space is formed between a surface of the support plate, the surface being on the counter side of the polishing pad, and the head body; a second recessed portion which is formed in the surface of the support plate, the surface opposing the polishing pad; a second film-like member which is formed on the surface of the support plate, the surface opposing the polishing pad, to seal the second recessed portion, in which a second space is formed between the second film-like member and the support plate, and which holds an object to be processed on a surface opposing the polishing pad; a communicating hole which is formed in the support plate to communicate the first space with the second space; a pressure device which increases pressures in the first space and the second space with a fluid to equal pressures to bring the object into press contact with the polishing pad through the second film-like member; and a retainer which is arranged on a surface of the head body, the surface opposing the polishing pad, which surrounds the object, and which is brought into contact with the polishing pad.

A second aspect of the present invention provides the polishing head according to the first aspect, further comprising an alignment member which is arranged on one of the head body and the support plate to support a surface of the first film-like member, the surface opposing the polishing pad, and wherein a support area of the first film-like member is changed by the alignment member to adjust a depressing force acting on the support plate by the pressure in the first space, thereby controlling a position of the support plate based on the head body.

A third aspect of the present invention provides the polishing head according to the second aspect, wherein the alignment member is detachably arranged on the head body and includes a ring-like member which supports an outer peripheral portion of a surface of the first film-like member, the surface opposing the polishing pad.

A fourth aspect of the present invention provides the polishing head according to the second aspect, wherein the alignment member is detachably arranged on an inner peripheral portion of the head body and includes a ring-like member which supports an outer peripheral portion of the surface of the first film-like member, the surface opposing the polishing pad.

A fifth aspect of the present invention provides the polishing head according to the second aspect, wherein the alignment member is detachably arranged on the support plate and includes a ring-like member which supports an inner peripheral portion of the surface of the first film-like member, the surface opposing the polishing pad.

A sixth aspect of the present invention provides the polishing head according to the second aspect, wherein the alignment member is detachably arranged on the outer peripheral portion of the support plate and includes a ring-like member which supports an inner peripheral portion of the surface of the first film-like member, the surface opposing the polishing pad.

A seventh aspect of the present invention provides the polishing head according to the second aspect, wherein the alignment member is arranged in such a state that the alignment member overlaps the head body and includes a plurality of ring-like member having a plurality of projecting portions formed on inner peripheral surfaces of the ring-like members.

An eighth aspect of the present invention provides the polishing head according to the second aspect, wherein the alignment member includes: a ring-like support member which is fixed to the head body and which has a plurality of insertion holes formed at predetermined intervals in a circumferential direction; and insertion plates which are movably inserted into the insertion holes and which project on the inside of the support member in a radial direction to support an outer peripheral portion of the surface of the first film-like member, the surface opposing the polishing pad.

A ninth aspect of the present invention provides the polishing head according to the second aspect, further comprising a drive device to change a support area of the first film-like member.

A tenth aspect of the present invention provides the polishing head according to the eighth aspect, wherein curved portions are formed on an inner surface of the insertion hole and the insertion plate, respectively, and the curved portion formed on the inner surface of the insertion hole is engaged with the curved portion formed on the insertion plate to keep depth the insertion plate at a desired.

According to an eleventh aspect of the present invention, there is provided a polishing apparatus comprising: a polishing pad having a polishing surface for polishing an object to be processed; and a polishing head which arranged to oppose the polishing surface and which holds the object to bring the object into press contact with the polishing surface, and wherein the polishing head comprises: a head body which is arranged to oppose the polishing surface of the polishing pad; a first recessed portion which is formed in a surface of the head body, the surface opposing the polishing pad; a support plate which is arranged in the first recessed portion, substantially in parallel with the polishing surface and which can be moved in directions in which the support plate is brought into contact with the head body or separated from the head body; a first film-like member which is arranged to extend from a surface of the support plate, the surface opposing the head body, to an inner surface of the first recessed portion and in which a first space is formed between a surface of the support plate, the surface being on the counter side of the polishing pad, and the head body; a second recessed portion which is formed in the surface of the support plate, the surface opposing the polishing pad; a second film-like member which is formed on the surface of the support plate, the surface opposing the polishing pad, to seal the second recessed portion, in which a second space is formed between the second film-like member and the support plate, and which holds an object to be processed on a surface opposing the polishing pad; a communicating hole which is formed in the support plate to communicate the first space with the second space; a pressure device which increases pressures in the first space and the second space with a fluid to equal pressures to bring the object into press contact with the polishing pad through the second film-like member; and a retainer which is arranged on a surface of the head body, the surface opposing the polishing pad, which surrounds the object, and which is brought into contact with the polishing pad.

According to the present invention, the surface of the object can be accurately polished without being influenced by the thickness of the object or the thickness of the retainer.

Even though a pressure given to bring the object into press contact with the polishing pad changes, the surface of the object can be polished at uniform polishing rate in the radial direction of the object.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Preferred embodiments of the present invention will be described below with reference to the accompanying drawings.

A first embodiment of the present invention will be described below with reference to FIGS. 1 to 3.

Figure 1:
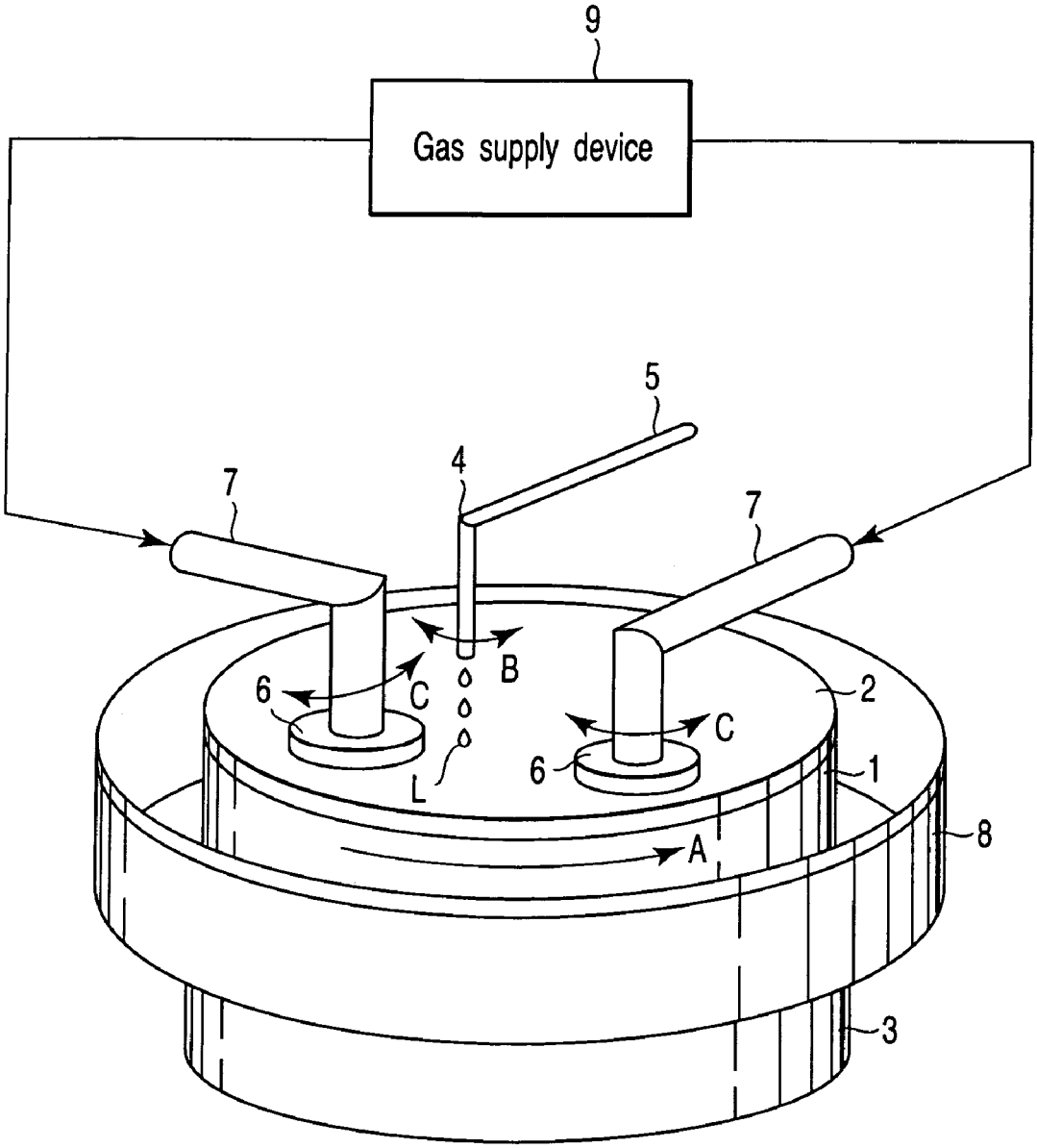
FIG. 1 is a perspective view of a wafer polishing apparatus according to a first embodiment of the present invention.

FIG. 1 is a perspective view of a wafer polishing apparatus according to the first embodiment of the present invention.

As shown in FIG. 1, the wafer polishing apparatus (polishing apparatus) has a machine platen 1. The machine platen 1 is formed in the form of a disk. A polishing pad 2 is stuck on the upper surface of the machine platen 1. The material of the polishing pad 2 is appropriately selected depending on the material of a polishing layer of a wafer U. A drive shaft (not shown) of a drive device 3 is connected to the lower portion of the machine platen 1. The drive shaft is rotated to make it possible to rotate the machine platen 1 in a direction indicated by an arrow A.

A polishing liquid supply pipe 4 is arranged above the polishing pad 2 stuck on the machine platen 1 to oppose the polishing pad 2. The polishing liquid supply pipe 4 is supported by a first oscillating arm 5 which oscillates in directions indicated by an arrow B on the polishing pad 2. A polishing liquid L is supplied from the supply port of the polishing liquid supply pipe 4 onto the upper surface of the polishing pad 2. As the polishing liquid L, for example, an alkaline solution containing colloidal silica is used.

A plurality of polishing heads 6 (in the embodiment, two polishing heads) are arranged above the polishing pad 2 stuck on the machine platen 1 to oppose each other. Each polishing head 6 is supported by a second oscillating arm 7 which oscillates in directions indicated by an arrow C on the polishing pad 2. The second oscillating arm 7 is moved downward to make it possible to bring the polishing head 6 into press contact with the upper surface of the polishing pad 2. Each second oscillating arm 7 is formed in the form of a tube. A gas supply pipe, a motor, and the like (to be described later) are arranged in the second oscillating arm 7.

Figure 2:
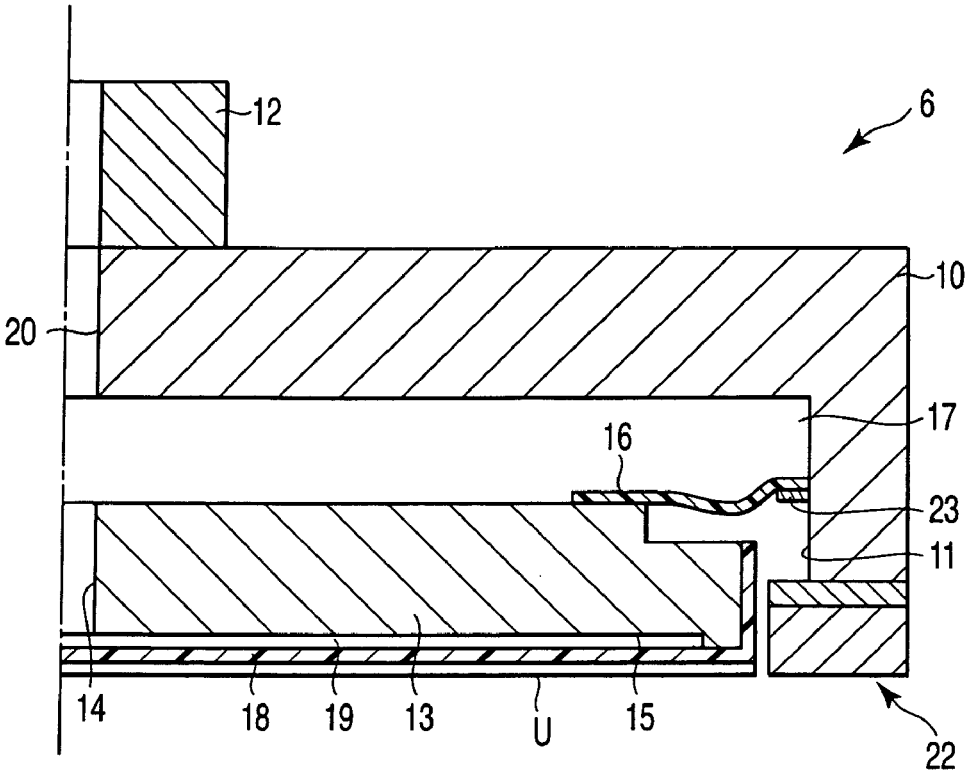
FIG. 2 is a sectional view of a polishing head according to the embodiment.

FIG. 2 is a sectional view of the polishing head 6 according to the embodiment.

As shown in FIG. 2, the polishing head 6 has a head body 10. A drive shaft 12 is almost vertically arranged on the upper surface of the head body 10. The drive shaft 12 is connected to the motor arranged in the second oscillating arm 7. The motor is driven to make it possible to rotate the head body 10 about the center of axis of the motor.

A first recessed portion 11 is arranged on the lower surface of the head body 10. The first recessed portion 11 is formed in the form of a columnar recessed portion, and a support plate 13 formed in the form of a disk is almost horizontally arranged inside the first recessed portion 11. The support plate 13 is supported such that the support plate 13 can move up and down based on the head body 10. A communicating hole 14 which almost vertically communicates is formed in the central portion of the support plate 13 in the radial direction, and a second recessed portion 15 which is a columnar recessed portion is formed in the lower surface of the support plate 13.

A belt-shaped first film-like member 16 is formed over the entire circumference of the support plate 13 between the support plate 13 and the head body 10. The first film-like member 16 is bridged from the edge portion of the support plate 13 to the inner peripheral surface of the head body 10. In this manner, a first space 17 is formed on the upper surface side of the support plate 13. As the material of the first film-like member 16, a material such as a resin having flexibility is used.

A second film-like member 18 to hold a wafer U (object to be processed) is arranged on the lower surface of the support plate 13. The second film-like member 18 seals the second recessed portion 15. In this manner, a second space 19 is formed between the second film-like member 18 and the support plate 13. As the material of the second film-like member 18, a material such as a membrane having flexibility is used.

A communicating hole 20 which communicates is formed in the almost central portion of the head body 10 in the radial direction. The communicating hole 20 is connected to a gas supply device 9 (see FIG. 1) serving as a pressure device through the gas supply pipe (not shown) arranged in the second oscillating arm 7. The gas supply device 9 is operated to make it possible to set the pressures in the first and second spaces 17 and 19 to desired pressures.

A retainer ring 22 (retainer) is arranged on a portion of the polishing pad of the head body 10 such that the retainer ring 22 is in contact with the portion. The retainer ring 22 surrounds the wafer U held on the lower surface of the second film-like member 18 to prevent the wafer U from dropping out of the polishing head 6.

A ring-like alignment member 23 is detachably arranged on the side surface of the recessed portion of the head body 10. The ring-like alignment member 23 has an inner peripheral portion which projects on the inside of the head body 10 in the radial direction. The projecting portion supports the outer peripheral portion of the lower surface of the first film-like member 16 to prevent the outer peripheral portion of the first film-like member 16 from being bent downward.

In use of the wafer polishing apparatus having the above configuration, first, a wafer U for selecting an alignment member is adhesively fixed on the lower surface of the second film-like member 18 arranged in the head body 10. The polishing pad 2 and the polishing head 6 are rotated to move the second oscillating arm 7 downward.

When the retainer ring 22 is brought into contact with the polishing pad 2 by the downward movement of the second oscillating arm 7, the gas supply device 9 is operated to increase the pressures in the first and second spaces 17 and 19 to desired pressures. In this manner, the wafer U held on the lower surface of the second film-like member 18 is brought into press contact with the surface of the polishing pad 2.

At this time, the pressure in the first space 17 and the pressure in the second space 19 cause welding forces to act on the upper surface and the lower surface of the support plate 13. When the welding forces are unbalanced, the support plate 13 shifts from a desired level, and the second film-like member 18 may expands downward or upward. In this case, the contact pressure between the polishing pad 2 and the wafer U cannot be uniformed over the entire surface of the wafer U.

Therefore, in the present invention, a plurality of alignment members having different internal diameters are prepared. An alignment member 23 having an optimum internal diameter is selected from these alignment members and attached to the head body 10 to align the support plate 13 to an optimum level, i.e., a level at which the contact pressure between the polishing pad 2 and the wafer U is uniform over the entire surface of the wafer U.

The method of aligning the level of the support plate 13 will be briefly described below.

When the ring-like alignment member 23 is attached to the head body 10, the inner peripheral portion of the ring-like alignment member 23 supports the outer peripheral portion of the lower surface of the first film-like member 16 to prevent the outer peripheral portion of the first film-like member 16 from bending downward. For this reason, since the pressure in the first space 17 partially acts on the head body 10 through the alignment member 23, the force that depresses the support plate 13 decreases depending on an amount of projection of the alignment member 23 based on the inside of the head body 10 in the radial direction.

Therefore, when an alignment member having an optimum internal diameter is selected and attached to the head body 10, the welding forces acting on the upper surface and the lower surface of the support plate 13 are balanced to make it possible to set the support plate 13 to an optimum level, i.e., at a level at which a contact pressure between the polishing pad 2 and the wafer U is uniform over the entire surface of the wafer U.

When the support plate 13 is set to the optimum level, the wafer U for selecting an alignment member is removed, and a wafer U to be processed is held on the lower surface of the second film-like member 18. The polishing pad 2 and the polishing head 6 are rotated to move the second oscillating arm 7 downward.

When the retainer ring 22 is brought into contact with the polishing pad 2 by the downward movement of the second oscillating arm 7, a gas is supplied from the gas supply device 9 into the first space 17 to increase the pressures in the first and second spaces 17 and 19 to predetermined pressures. In this manner, the wafer U held on the lower surface of the second film-like member 18 is brought into press contact with the surface of the polishing pad 2, so that the surface of the wafer U is polished at a uniform polishing rate.

According to the wafer polishing apparatus having this configuration, the first space 17 formed on the upper surface side of the support plate 13 is caused to communicate with the second space 19 formed on the lower surface side of the support plate 13 through the communicating hole 14, so that the pressures in the first and second spaces 17 and 19 are equal to each other.

For this reason, even though the pressure of the gas supplied by the gas supply device 9 changes, since the pressure in the first space 17 and the pressure in the second space 19 simultaneously and equally change, the level of the support plate 13 rarely changes.

Therefore, even though the welding force of the gas supply device 9 becomes unstable during polishing of the wafer U, the contact pressure between the polishing pad 2 and the wafer U does not change. For this reason, the wafer U can be accurately polished at a uniform polishing rate.

Figure 3:
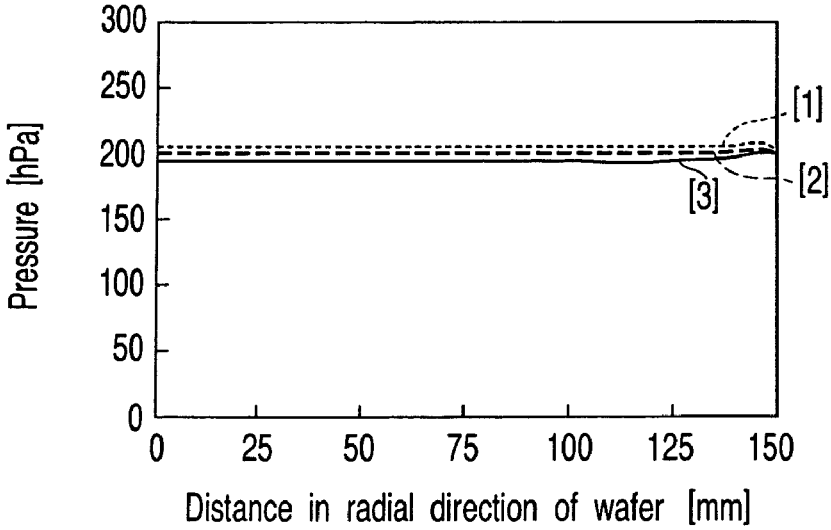
FIG. 3 is a simulation graph showing a change in contact pressure in the radial direction of the wafer U when pressures in the first space and the second space according to the embodiment is changed.

FIG. 3 is a simulation graph showing a change in contact pressure in the radial direction of the wafer U when pressures in the first space 17 and the second space 19 according to the embodiment. The pressures given to the first and second spaces 17 and 19 are changed into [1] 205 [hPa], [2] 200 [hPa], and [3] 195 [hPa].

As shown in FIG. 3, even though the pressures in the first and second spaces 17 and 19 are changed into [1] 205 [hPa], [2] 200 [hPa], and [3] 195 [hPa], a contact pressure between the wafer U and the polishing pad 2 rarely changes in the radial direction of the wafer U.

In this manner, when the wafer U is polished by using the wafer polishing apparatus according to the embodiment of the present invention, the following can be confirmed. That is, even though the pressures in the first and second spaces 17 and 19 are changed, the changes in pressure do not influence the polishing of the wafer U.

In the embodiment, the gas is supplied into the first and second spaces 17 and 19. However, the gas is not always used, and a liquid may be supplied in place of the gas. Although the wafer U is used as an object to be processed, the object is not limited to the wafer.

A second embodiment of the present invention will be described below with reference to FIG. 4.

Figure 4:
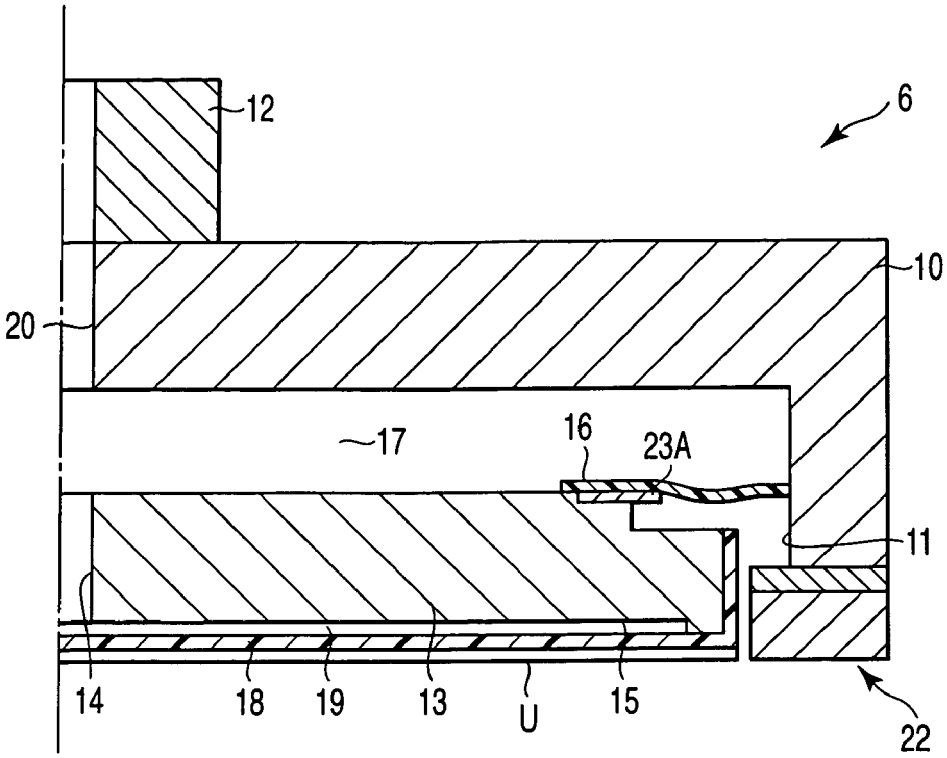
FIG. 4 is a sectional view of a polishing head according to a second embodiment of the present invention.

FIG. 4 is a sectional view of a polishing head according to the second embodiment of the present invention.

As shown in FIG. 4, an alignment member 23A according to the embodiment is arranged on the outer peripheral portion of the upper surface of a support plate 13. The alignment member 23A is in contact with the inner peripheral portion of the lower surface of a first film-like member 16 to prevent the inner peripheral portion of the first film-like member 16 from bending downward at a portion projecting on the outside of the support plate 13 in the radial direction.

In this manner, even though the alignment member 23A is arranged on the support plate 13, the plurality of alignment members 23A having different outer diameters are prepared, and a alignment member 23A having an optimum outer diameter is selected from the plurality of alignment members 23A, so that force that depresses the support plate 13 can be adjusted. For this reason, the same effect as that of the first embodiment can be obtained.

A third embodiment of the present invention will be described below with reference to FIG. 5.

Figure 5:
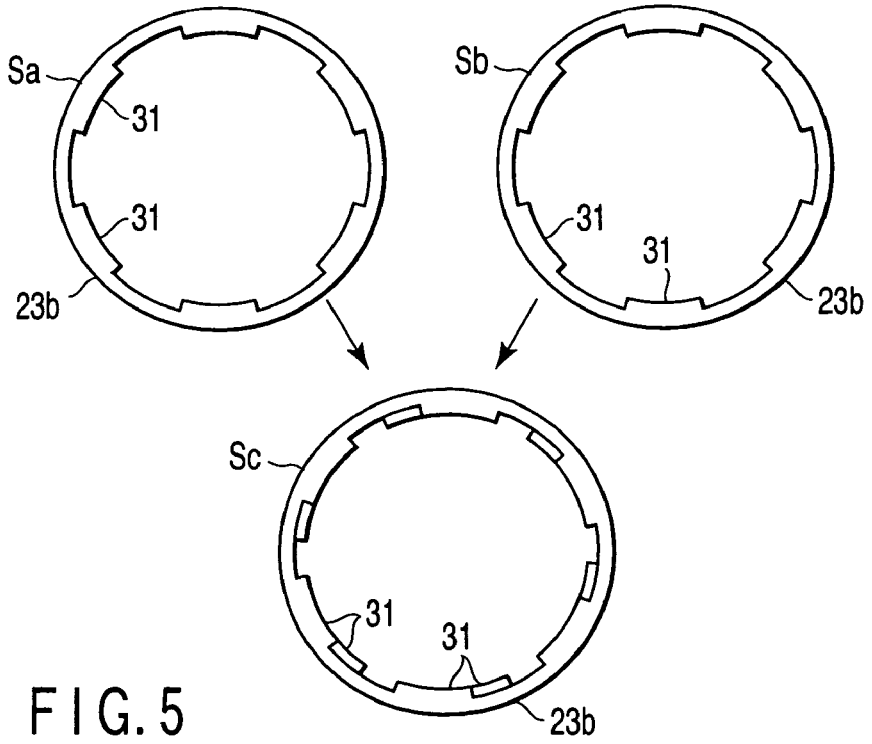
FIG. 5 is a plan view of an alignment member according to a third embodiment of the present invention.

FIG. 5 is a plan view of an alignment member according to the third embodiment of the present invention.

As indicated by Sa and Sb in FIG. 5, an alignment member 23B is constituted by two ring-like members 23*b* having the same shapes. These ring-like members 23*b* are detachably arranged on the head body 10 in such a state that the ring-like members 23*b* overlap. On the inner peripheral portion of each member 23*b*, a plurality of projecting portions 31 which prevent the outer peripheral portion of a first film-like member 16 from bending downward are arranged at predetermined intervals in the circumferential direction.

As indicated by Sc in FIG. 5, the two members 23*b* are caused to coaxially overlap each other, and the alignment member 23 are shifted in the circumferential direction, so that a support area of the first film-like member 16 supported by the alignment member 23B can be changed. For this reason, since force that depresses the support plate 13 can be adjusted, the same effect as that of the first embodiment can be obtained.

In addition, when the members 23*b* are merely shifted from each other, the support area of the first film-like member 16 can be changed in a stepless manner. For this reason, when the two members 23*b* are prepared, the polishing apparatus can cope with the various thicknesses of wafers F or the various thicknesses of retainer rings 22.

A fourth embodiment of the present invention will be described below with reference to FIGS. 6 to 8.

Figure 6:
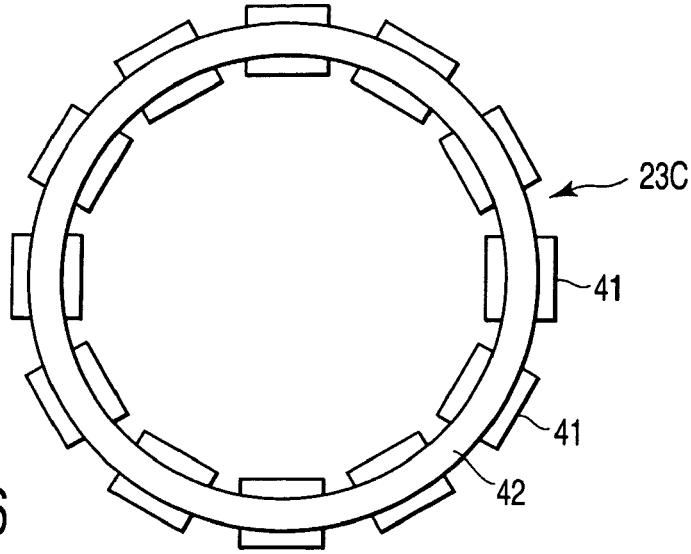
FIG. 6 is a plan view of an alignment member according to a fourth embodiment of the present invention.
Figure 7:
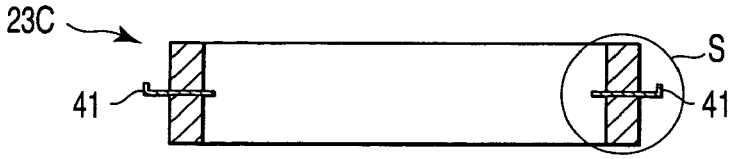
FIG. 7 is a sectional view of the alignment member according to the fourth embodiment.
Figure 8:
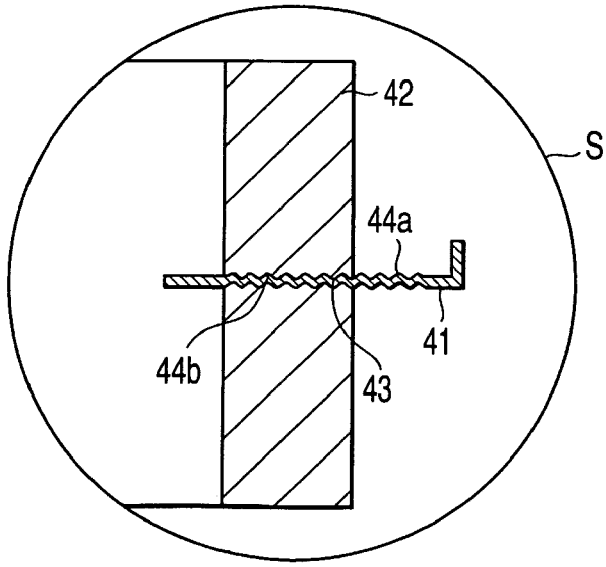
FIG. 8 is an enlarged view showing a portion indicated by S in FIG. 7 in close-up.

FIG. 6 is a plan view of an alignment member according to the fourth embodiment of the present invention, FIG. 7 is a sectional view of the alignment member according to the embodiment, and FIG. 8 is an enlarged view showing a portion indicated by S in FIG. 7 in close-up.

As shown in FIGS. 6 to 8, an alignment member 23C according to the embodiment is constituted by a plurality of insertion plates 41 which prevent the outer peripheral portion of a first film-like member 16 from bending downward and a support member 42 which is arranged on the head body 10 to support the insertion plates 41.

A plurality of insertion holes 43 are radially formed in the support member 42 at predetermined intervals in the circumferential direction. The insertion plates 41 are movably inserted into the insertion holes 43, respectively. Wavy curved surfaces 44*a* and 44*b* (curved portions) are formed on the surfaces of the insertion plates 41 and the inner surfaces of the insertion holes 43, respectively. The curved surfaces 44*a* and 44*b* are engaged with each other to make it possible to hold the insertion plates 41 at desired depths.

When the alignment member 23C is used, as in the embodiment, amounts of projection of the insertion plates 41 can be controlled without decomposing a polishing head 6. For this reason, an operation that aligns the level of a support plate 13 can be easily performed.

A fifth embodiment of the present invention will be described below with reference to FIG. 9.

Figure 9:
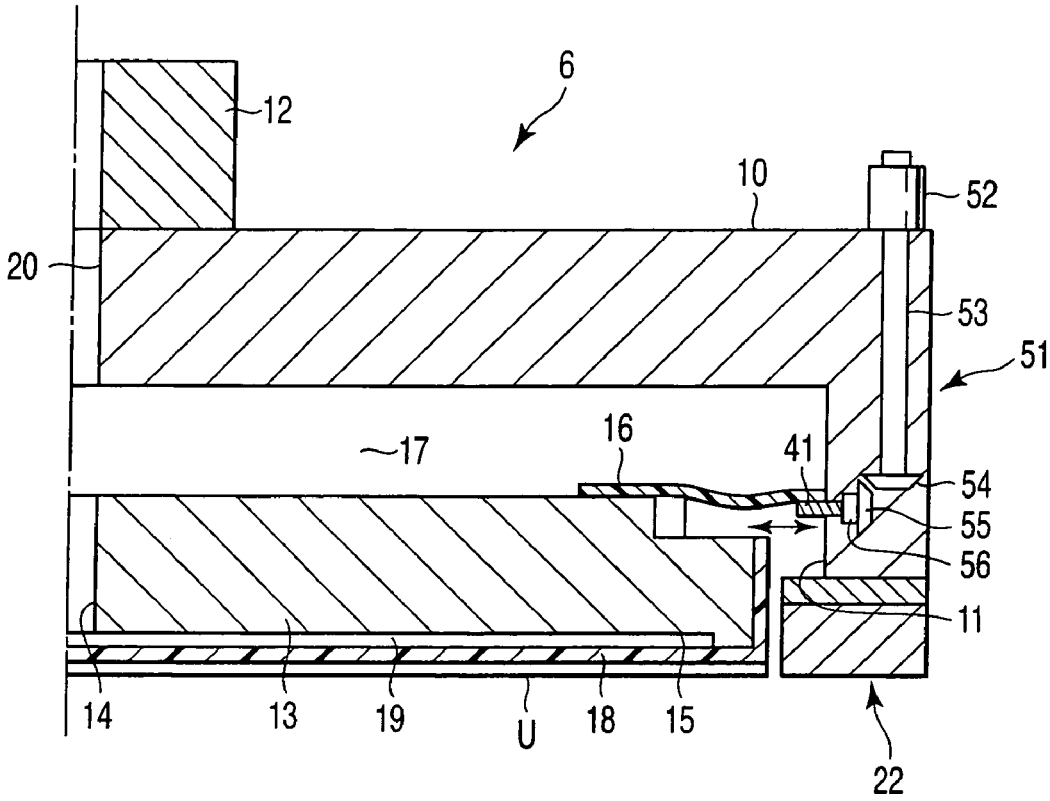
FIG. 9 is a sectional view of a polishing head according to a fifth embodiment of the present invention.
Figure 10:
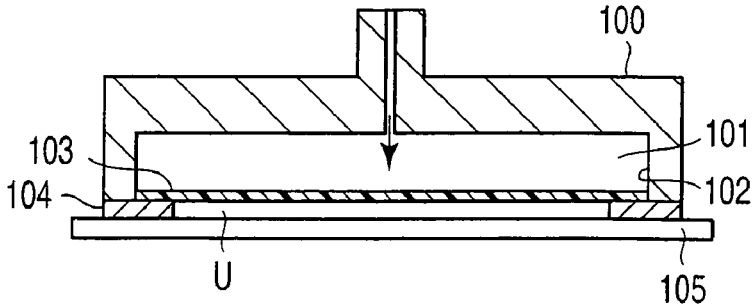
FIG. 10 BACKGROUND ART
FIG. 10 is a sectional view of a conventional polishing head.
Figure 11A:
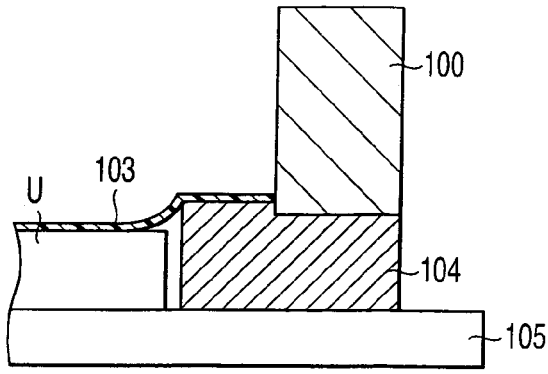
FIG. 11A BACKGROUND ART
FIG. 11A is a schematic view showing a relationship between a retainer and a rubber film when a vertical thickness is large.
Figure 11B:
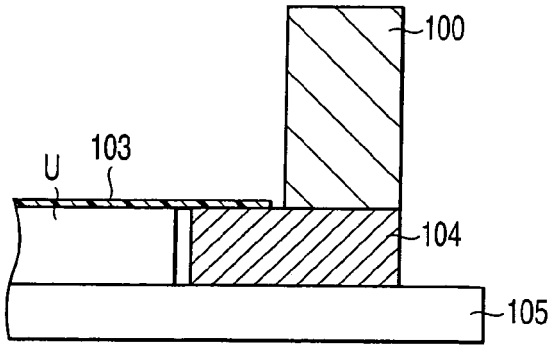
FIG. 11B BACKGROUND ART
FIG. 11B is a schematic view showing a relationship between the retainer and the rubber film when the vertical thickness is proper.
Figure 11C:
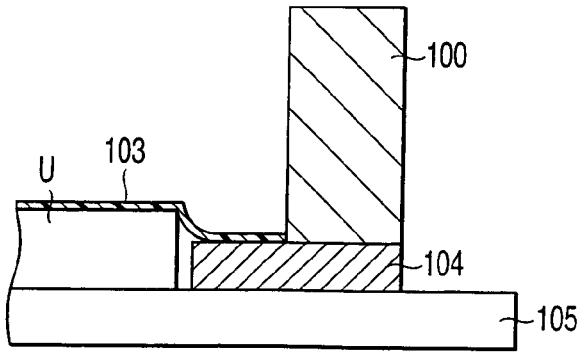
FIG. 11C BACKGROUND ART
FIG. 11C is a schematic view showing a relationship between the retainer and the rubber film when the vertical thickness is small.
Figure 12:
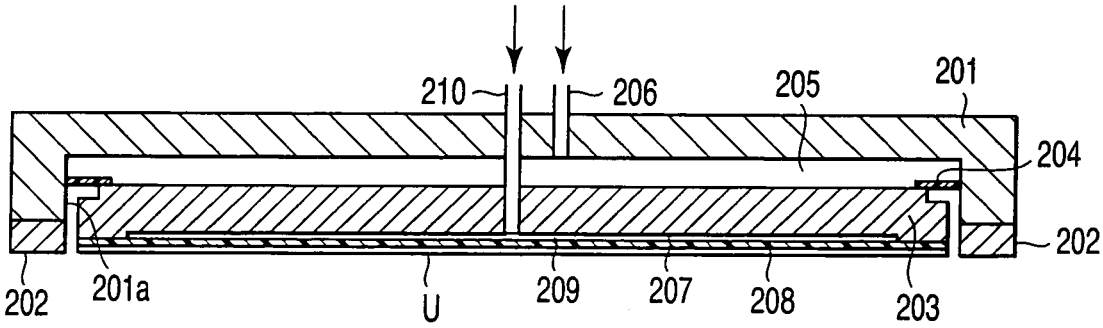
FIG. 12 BACKGROUND ART
FIG. 12 is a sectional view of a conventional separation type polishing head.
Figure 13:
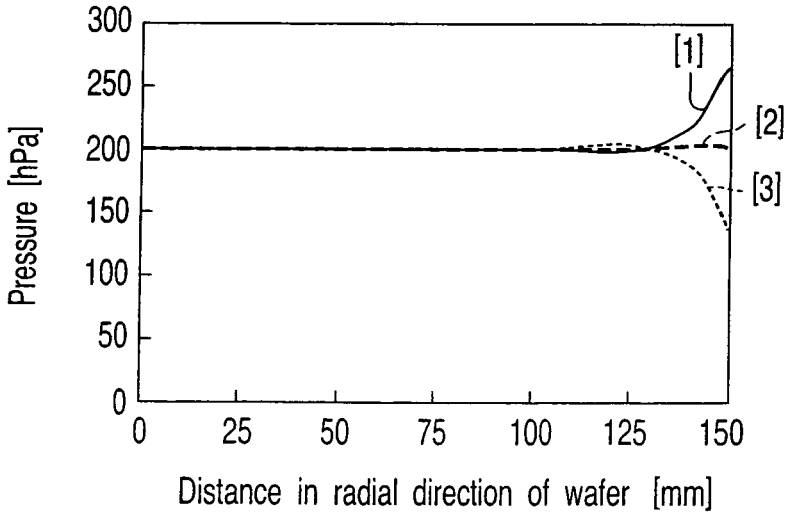
FIG. 13 BACKGROUND ART
FIG. 13 is a simulation graph showing a change in contact pressure in the radial direction of a wafer U when a pressure in the first space is changed.

FIG. 9 is a sectional view of a polishing head according to the fifth embodiment of the present invention.

As shown in FIG. 9, a head body 10 according to the embodiment includes a drive device 51 which reciprocally moves the insertion plate 41 according to the fourth embodiment. The drive device 51 is constituted by a motor 52 arranged on the upper surface of a head body 10, a drive shaft 53 connected to the motor 52, a first bevel gear 54 arranged at the distal end of the drive shaft 53, a second bevel gear 55 meshed with the first bevel gear 54, and a reciprocating mechanism 56 which is connected to the second bevel gear 55 and reciprocates the insertion plate 41 in conjunction with the motion of the second bevel gear 55.

In this manner, since the drive device 51 which reciprocally drives the insertion plate 41 is arranged, all the steps including the step of aligning the level of the support plate 13 can be automated to make it possible to improve the productivity and realize a reduction in cost.

The present invention is not directly limited to the embodiments. The present invention can be embodied by modifying components without departing from the spirit and scope of the invention in the execution phase. In addition, various inventions can be formed by appropriate combinations of a plurality of components disclosed in the embodiments. For example, several components may be deleted from all the component described in the embodiment. In addition, components described in different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A polishing head comprising:

a head body which is arranged to oppose a polishing surface of a polishing pad;

a first recessed portion which is formed in a surface of the head body, the surface opposing the polishing pad;

a support plate which is arranged in the first recessed portion, substantially in parallel with the polishing surface and which can be moved in directions in which the support plate is brought into contact with the head body or separated from the head body;

a first film-like member which is arranged to extend from a surface of the support plate, the surface opposing the head body, to an inner surface of the first recessed portion and in which a first space is formed between a surface of the support plate, the surface being on the counter side of the polishing pad, and the head body;

a second recessed portion which is formed in the surface of the support plate, the surface opposing the polishing pad;

a second film-like member which is formed on the surface of the support plate, the surface opposing the polishing pad, to seal the second recessed portion, in which a second space is formed between the second film-like member and the support plate, and which holds an object to be processed on a surface opposing the polishing pad;

a communicating hole which is formed in the support plate to communicate the first space with the second space;

a pressure device which increases pressures in the first space and the second space with a fluid to equal pressures to bring the object into press contact with the polishing pad through the second film-like member; and a retainer which is arranged on a surface of the head body, the surface opposing the polishing pad, which surrounds the object, and which is brought into contact with the polishing pad.

2. The polishing head according to claim 1, further comprising an alignment member which is arranged on one of the head body and the support plate to support a surface of the first film-like member, the surface opposing the polishing pad, and wherein a support area of the first film-like member is changed by the alignment member to adjust a depressing force acting on the support plate by the pressure in the first space, thereby controlling a position of the support plate based on the head body.

3. The polishing head according to claim 2, wherein the alignment member is detachably arranged on the head body and includes a ring-like member which supports an outer peripheral portion of a surface of the first film-like member, the surface opposing the polishing pad.

4. The polishing head according to claim 2, wherein the alignment member is detachably arranged on an inner peripheral portion of the head body and includes a ring-like member which supports an outer peripheral portion of the surface of the first film-like member, the surface opposing the polishing pad.

5. The polishing head according to claim 2, wherein the alignment member is detachably arranged on the support plate and includes a ring-like member which supports an inner peripheral portion of the surface of the first film-like member, the surface opposing the polishing pad.

6. The polishing head according to claim 2, wherein the alignment member is detachably arranged on the outer peripheral portion of the support plate and includes a ring-like member which supports an inner peripheral portion of the surface of the first film-like member, the surface opposing the polishing pad.

7. The polishing head according to claim 2, wherein the alignment member is arranged in such a state that the alignment member overlaps the head body and includes a plurality of ring-like member having a plurality of projecting portions formed on inner peripheral surfaces of the ring-like members.

8. The polishing head according to claim 2, wherein the alignment member includes:

a ring-like support member which is fixed to the head body and which has a plurality of insertion holes formed at predetermined intervals in a circumferential direction; and insertion plates which are movably inserted into the insertion holes and which project on the inside of the support member in a radial direction to support an outer peripheral portion of the surface of the first film-like member, the surface opposing the polishing pad.

9. The polishing head according to claim 2, further comprising a drive device to change a support area of the first film-like member.

10. The polishing head according to claim 8, wherein curved portions are formed on an inner surface of the insertion hole and the insertion plate, respectively, and the curved portion formed on the inner surface of the insertion hole is engaged with the curved portion formed on the insertion plate to keep depth the insertion plate at a desired.

11. A polishing apparatus comprising:

a polishing pad having a polishing surface for polishing an object to be processed; and a polishing head which arranged to oppose the polishing surface and which holds the object to bring the object into press contact with the polishing surface, and wherein the polishing head comprises:

a head body which is arranged to oppose the polishing surface of the polishing pad;

a first recessed portion which is formed in a surface of the head body, the surface opposing the polishing pad;

a support plate which is arranged in the first recessed portion, substantially in parallel with the polishing surface and which can be moved in directions in which the support plate is brought into contact with the head body or separated from the head body;

a first film-like member which is arranged to extend from a surface of the support plate, the surface opposing the head body, to an inner surface of the first recessed portion and in which a first space is formed between a surface of the support plate, the surface being on the counter side of the polishing pad, and the head body;

a second recessed portion which is formed in the surface of the support plate, the surface opposing the polishing pad;

a second film-like member which is formed on the surface of the support plate, the surface opposing the polishing pad, to seal the second recessed portion, in which a second space is formed between the second film-like member and the support plate, and which holds an object to be processed on a surface opposing the polishing pad;

a communicating hole which is formed in the support plate to communicate the first space with the second space;

a pressure device which increases pressures in the first space and the second space with a fluid to equal pressures to bring the object into press contact with the polishing pad through the second film-like member; and a retainer which is arranged on a surface of the head body, the surface opposing the polishing pad, which surrounds the object, and which is brought into contact with the polishing pad.

* * * * *